US009626870B2

(12) United States Patent
Füreder et al.

(10) Patent No.: US 9,626,870 B2
(45) Date of Patent: Apr. 18, 2017

(54) METHOD FOR COMMUNICATING WITHIN AN AD HOC-TYPE MOTOR VEHICLE COMMUNICATION SYSTEM

(71) Applicant: SIEMENS AKTIENGESELLSCHAFT, München (DE)

(72) Inventors: Herbert Füreder, Vienna (AT); Fritz Kasslatter, Gablitz (AT)

(73) Assignee: Siemens Aktiengesellschaft, München (DE)

( * ) Notice: Subject to any disclaimer, the term of this patent is extended or adjusted under 35 U.S.C. 154(b) by 13 days.

(21) Appl. No.: 14/403,074

(22) PCT Filed: Mar. 21, 2013

(86) PCT No.: PCT/EP2013/055975
§ 371 (c)(1),
(2) Date: Nov. 21, 2014

(87) PCT Pub. No.: WO2013/174541
PCT Pub. Date: Nov. 28, 2013

(65) Prior Publication Data

US 2015/0112590 A1 Apr. 23, 2015

(30) Foreign Application Priority Data

May 23, 2012 (DE) ..... 10 2012 208 646

(51) Int. Cl.
*G08G 1/00* (2006.01)
*G08G 1/16* (2006.01)

(52) U.S. Cl.
CPC ..... *G08G 1/22* (2013.01); *G08G 1/163* (2013.01)

(58) Field of Classification Search
None
See application file for complete search history.

(56) References Cited

U.S. PATENT DOCUMENTS

2003/0009275 A1 1/2003 Koike
2006/0176847 A1* 8/2006 Chen ..... G08G 1/161 370/328

(Continued)

FOREIGN PATENT DOCUMENTS

| | | | |
|---|---|---|---|
| AT | 414279 | B | 10/2006 |
| DE | 102007027651 | A1 | 12/2008 |
| DE | 102008036131 | A1 | 3/2009 |
| DE | 102010049721 | A1 | 4/2012 |
| EP | 1223567 | A1 | 7/2002 |

OTHER PUBLICATIONS

Car 2 Car Communication Consortium, Manifesto, Overview of the C2C-CC System, Aug. 28, 2007, pp. 1-94.

(Continued)

*Primary Examiner* — Jelani Smith
(74) *Attorney, Agent, or Firm* — Lempia Summerfield Katz LLC

(57) ABSTRACT

A method for communicating based on an ad hoc-type motor vehicle communication system, in which transportation users communicate with one another and/or transportation users and the transportation infrastructure communicate, includes determining the valid directions of travel independently based on messages transmitted by transportation users and determining travel in the wrong direction based on these messages. Corresponding further messages may be transmitted in response to the hazardous situation. A transportation infrastructure device and to a transportation user device may implement the method.

18 Claims, 5 Drawing Sheets

(56) References Cited

U.S. PATENT DOCUMENTS

| | | | | |
|---|---|---|---|---|
| 2007/0043502 | A1 | 2/2007 | Mudalige et al. | |
| 2009/0122738 | A1* | 5/2009 | Chen | H04H 20/08 370/312 |
| 2011/0044172 | A1* | 2/2011 | Yim | H04L 47/14 370/236 |
| 2011/0210866 | A1* | 9/2011 | David | G08G 1/166 340/903 |

OTHER PUBLICATIONS

Chih-Che Lin et al., "A Vehicle Group Communication System Using IEEE 1609/802.11(p) Radios", Vehicular Technology Conference (VTC Fall), Sep. 5-8, 2011, pp. 1-2, XP32029748.

Draft ETSI TR 102 638 V1.0.5, Intelligent Transport Systems (ITS); Vehicular Communications; Basic Set of Applications; Definitions, Technical Report, Apr. 15, 2009, pp. 1-78, XP014072942.

German Office Action in corresponding German Patent Application No. DE 10 2012 208 646.3, dated Jan. 30, 2013, with English translation.

International Search Report in corresponding PCT Application No. PCT/EP2013/055975, dated Jul. 9, 2013, with English translation.

International Search Report in corresponding PCT Application No. PCT/EP2013/055975, dated Jun. 5, 2014, with English translation.

International Search Report in corresponding PCT Application No. PCT/EP2013/055975, dated Oct. 16, 2014, with English translation.

M. Sepulcre et al., "On the Importance of Application Requirements in Cooperative Vehicular Communications", 2011 Eighth International Conference on Wireless On-Demand Network Systems and Services, 2011, pp. 125-131.

* cited by examiner

METHOD FOR COMMUNICATING WITHIN AN AD HOC-TYPE MOTOR VEHICLE COMMUNICATION SYSTEM

The present patent document is a §371 nationalization of PCT Application Serial Number PCT/EP2013/055975, filed Mar. 21, 2013, designating the United States, which is hereby incorporated by reference in its entirety. This patent document also claims the benefit of DE 10 2012 208 646.3, filed on May 23, 2012, which is also hereby incorporated by reference in its entirety.

FIELD

The invention relates to a method for communicating within an ad hoc-type motor vehicle communication system.

BACKGROUND

So-called wrong-way drivers or ghost drivers occasionally occur in road transportation. Transportation users steer their vehicle in the wrong direction on the road and therefore meet vehicles moving in the correct direction in the lane. Such accidents usually occur on freeways, e.g., at freeway entrances that are used incorrectly, or one-way streets. A lack of knowledge of the local transportation routing, as well as confusing or poor sign-posting or distraction of the driver, are the most frequent causes of driving in the wrong direction.

The resulting hazardous situation often results in serious and very serious accidents. As a result, one of the tasks in transportation includes avoiding these situations or, when such a situation occurs, resolving the situation with as little damage as possible.

The signage, whether fixed or dynamic in the form of transportation guidance systems, is used for the former approach. Cameras, radar or infrared detection devices are also sometimes used for this purpose. The cameras detect the vehicles traveling in the wrong direction and output corresponding warnings.

However, these systems are not comprehensively available.

Mechanical obstacles are also installed. However, these obstacles are configured such that the obstacles resolve the hazardous situation with the acceptance of material damage.

For the latter approach, the transportation users traveling in the correct direction give a signal to the wrong-way driver, for example, by turning the vehicle headlights to full beam. Because these vehicles are already moving toward each other in this case, it is scarcely possible to resolve the situation safely and harmlessly depending on the speed.

DE 10 2008 036 131 A1 discloses a system in which a vehicle extrapolates an estimation of existing and future hazardous situations using the currently available vehicle information. The information is transmitted from the vehicle traveling in front, such as current position, direction and speed, and a comparison with available map material.

DE 10 2010 049 721 A1 discloses a system that determines trajectories from messages from vehicles and determines future collision probabilities/hazardous situations based on the trajectories.

SUMMARY AND DESCRIPTION

The present embodiments may obviate one or more of the drawbacks or limitations in the related art. For example, a method, a transportation infrastructure device, and a transportation user device, are provided.

A method for communicating in an ad hoc-type motor vehicle communication system, such as a wireless motor vehicle communication system, in which transportation users communicate with one another and/or transportation users and the transportation infrastructure communicate, is described. The method includes transmitting, by at least one first radio transceiver device (e.g., radio transmission/radio reception device) associated with a first transportation user, at least one first message to at least one second radio transceiver device. The second radio transceiver device is in the radio supply area of the first radio transceiver device and is associated with a second transportation user or a transportation infrastructure device. In this case, the first message is transmitted such that a first direction of a position change of the first transportation user is determined based on the received first message. A history of determined directions is additionally formed based on first messages and a correlation between the first direction and the history of directions is determined. A decision on the presence of a hazardous situation is made based on the correlation. If the decision reveals a hazardous situation, the second radio transceiver device is used to transmit a second message to the first radio transceiver device.

With the method, traveling in a wrong direction may be signaled to wrong-way drivers by other transportation users and/or transportation infrastructure devices in an automated manner. Measures for eliminating the danger may be initiated in an automated manner and at an early time. There is no need to store information relating to the intended direction to the current place of occurrence because a probability for the correct direction results from the determination of the history of directions. As a result, the devices, whether mobile or stationary, may be installed at any desired location without adapting the location data for this purpose. The degree of correlation between the determined position of the first transportation user and the history again represents the probability of a position change of the vehicle possibly oriented in the wrong direction. When traveling in the opposite direction, which will generally be the most common type of wrong-way driving on the road, the degree of correlation will tend toward zero, for example. However, even if a vehicle deviates from the road, this may be determined via evaluation algorithms, with the result being that this may also be recognized as a possible hazardous situation.

In one embodiment, the first message is at least occasionally transmitted in a periodically repeated manner. The evaluation for determining the position change may become more reliable. The decision as to a hazardous situation may therefore also be made in a more reliable manner because not every brief movement in the wrong direction may be the intended direction of travel of the driver.

The duration of the period is predetermined (e.g., set) such that the implemented algorithm provides the same results everywhere. A value highly suitable for the evaluation and reliability is 100 ms in this case.

If the receiver of the first message, i.e., the second radio transceiver device, is associated with the transportation infrastructure, the decision is formed at least based on the fact that a value is determined for the time elapsed since the last first message and/or since the beginning of the recording of first messages. It is also determined whether a history is formable (e.g., may be formed) and/or whether there is a correlation and, if the value exceeds a period of time and a history may not be formed or if there is no correlation, the decision is made that there is a hazardous situation. This development takes into account the situation in which the receiver is accommodated in a stationary transportation infrastructure device. This is because the situation may arise in this case in which this device is at a location where a transportation user hardly moves, with the result that no first messages are received or no first messages are received for a very long time. In this case, it is therefore not possible to form a history due to the lack of first messages. It may also be the case that a first message was received so long ago that the transport routing has changed in the meantime. No information or no reliable information therefore results from the correlation either.

However, travel in the wrong direction may nevertheless be involved. The time reference is now useful because a warning may also be provided (e.g., as an output) as a precaution even though there is a correlation. As a result, a warning also becomes possible when no history may be generated because it is indeed the temporally first message of the first messages, with the result that no statement may be made on how the transportation users usually travel on the route in question. In addition, this development supports detection, namely that a history is formable and that the evaluation reveals that there is no correlation and the first transportation user is therefore highly likely to be traveling in the wrong direction.

Alternatively or additionally, it is advantageous if the decision is formed at least based on the fact that it is determined whether a history is formable and/or whether there is no correlation. This development is suitable, if the second radio transceiver device is associated with a second transportation user, because this transportation user may continuously receive first messages arising from his mobility and the checking of the time in order to determine whether it is the very first message is therefore not required because a history is always formed.

However, this development may supplement a time limit when determining the history, during which a reset is implemented repeatedly by a start event, for example, for performance by a second transportation user.

This would also be developed if these start events are triggered by infrastructure devices, e.g., by messages, for example, at entrances to a freeway, such that the system is aware that the history subsequently formed is decisive for this route.

The first message may contain a first item of information representing the direction of travel, position and/or speed of the first transportation user. The direction may be determined either directly or indirectly.

The second message may contain a second item of information that triggers a warning. With the warning, a receiver may initiate procedures that are suitable for resolving the hazardous situation.

The radio transceiver devices may be operated for data transmission according to a dedicated short-range radio communication standard, such as a dedicated short range communication (DSRC). Such short-range radio standards are suitable for communication between vehicles and other mobile transportation users and, as a result of the standardization, ensure that the interaction also functions. This functions very well when integrated with the WLAN standard 802.11 and the derivatives thereof, such as 802.11a/b/e/g/n/p.

If the radio transceiver devices are intended to be operated in Europe, it is useful if they are operated for data transmission according to the so-called wireless access in vehicular environments (WAVE) standard or derivatives thereof.

A defined radio interface of the radio transceiver devices is obtained in this case if the radio transceiver devices are operated for data transmission at least partially according to IEEE 1609.4 and/or European Telecommunications Standards Institute (ETSI) intelligent transportation systems (ITS) standards or the derivatives thereof.

The development in which the radio transceiver devices are operated for data transmission at least partially according to IEEE 802.11 standards or the derivatives thereof, such as IEEE 802.11p, has prevalence and penetration because every portable entertainment device, such as a cell phone or PDA, in the meantime has such a WLAN interface, with the result that these devices may be used for transport-relevant communication between transportation users without great changes. In this case, use of the IEEE 802.11p derivative is reliable in fast-moving objects such as motorized vehicles.

The radio transceiver devices and the associated method may communicate with transportation users at least partially according to a mobile radio standard such as GSM, UMTS or derivatives thereof. This is useful for better penetration and detection because, as already indicated, pedestrians and cyclists owning a mobile radio device (e.g., a cell phone) may likewise be integrated in communication as transportation users and a more comprehensive overall image of the transport may therefore be formed.

Further penetration is achieved if the radio transceiver devices are developed such that the devices are operated for communicating with transportation users at least partially according to the European standard ETSI TC ITS, the American vehicle safety communications program (VSC), or the Japanese advanced vehicle safety program (AVS). As a result, the device may be used in different parts of the world.

Alternatively or additionally, the radio transceiver devices may be operated such that the devices communicate with transportation users at least partially according to the ISO standard of continuous-air long and medium range (CALM). Therefore, the device may be used throughout the world, and this may also be done without changes or national adaptations, which is appropriate for the mobility concept of vehicles.

A transportation infrastructure device for communicating based on an ad hoc-type motor vehicle communication system, e.g., a wireless motor vehicle communication system, in which transportation users communicate with one another and/or transportation users and the transportation infrastructure communicate, is also described. In order to receive at least one first message transmitted by a first radio transceiver device associated with a first transportation user, the transportation infrastructure device includes a second radio transceiver device in the radio supply area of the first radio transceiver device. The transportation infrastructure device further includes means for determining a first direction of a position change of the first transportation user based on the first message, means for forming a history of determined directions based on first messages, and means for determining a correlation between the first direction and the history of directions. The transportation infrastructure device further includes means for making a decision on the presence of a hazardous situation based on the correlation, and means for forming a second message for transmission to the first radio transceiver device by the second radio transceiver device if the decision reveals a hazardous situation.

A transportation user device for communicating based on an ad hoc-type motor vehicle communication system, such as a wireless motor vehicle communication system, in which transportation users communicate with one another and/or transportation users and the transportation infrastructure communicate, is also described. The transportation user device is uses a first radio transceiver device associated therewith to transmit at least one first message to a second radio transceiver device in the radio supply area of the first radio transceiver device and associated with a second transportation user or a transportation infrastructure device. The first message is transmitted such that a first direction of a position change of the first transportation user is determined based on the received first message. The transportation user device also includes means for receiving a second message transmitted in the event of a decision and means for carrying out a procedure based on the hazardous situation.

The devices and apparatuses allow the method to be implemented, thereby increasing transport safety.

DETAILED DESCRIPTION

FIGS. 1A-1D schematically depict an exemplary embodiment of the invention in which the formation of a history (FIG. 1B) leads to stored trajectories LANE1, LANE2 and LANE3 (FIGS. 1C and 1D) based on directions of transportation users who traveled on the roads shown at an earlier time.

Figure 1A:
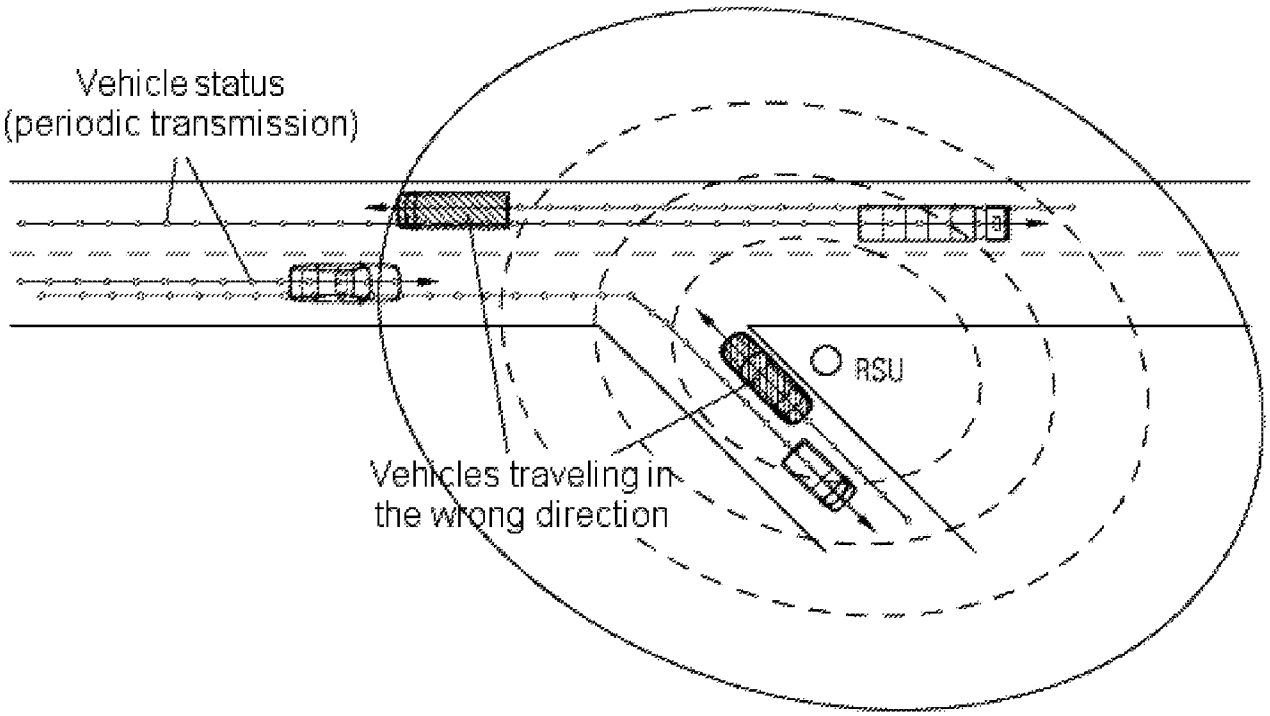
FIGS. 1A-1D schematically show transportation users in a mobile ad hoc network in accordance with one embodiment.
Figure 1B:
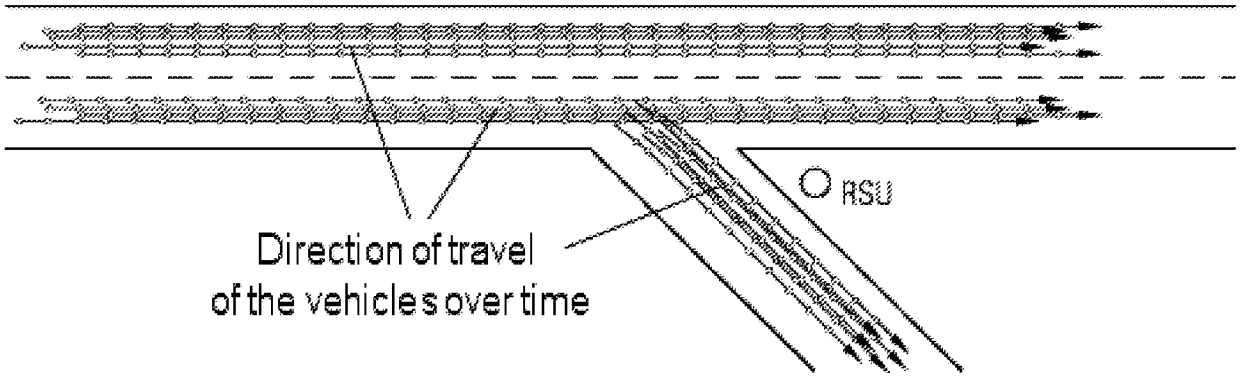
Figure 1C:
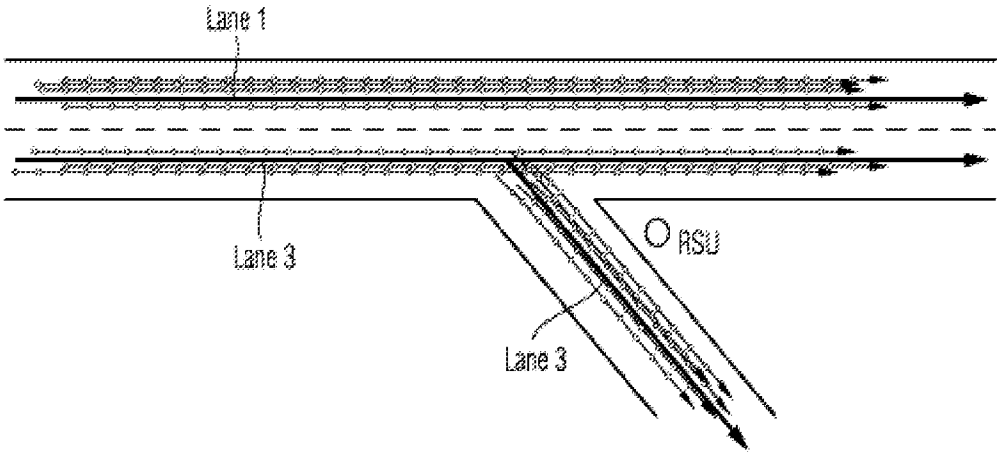
Figure 1D:
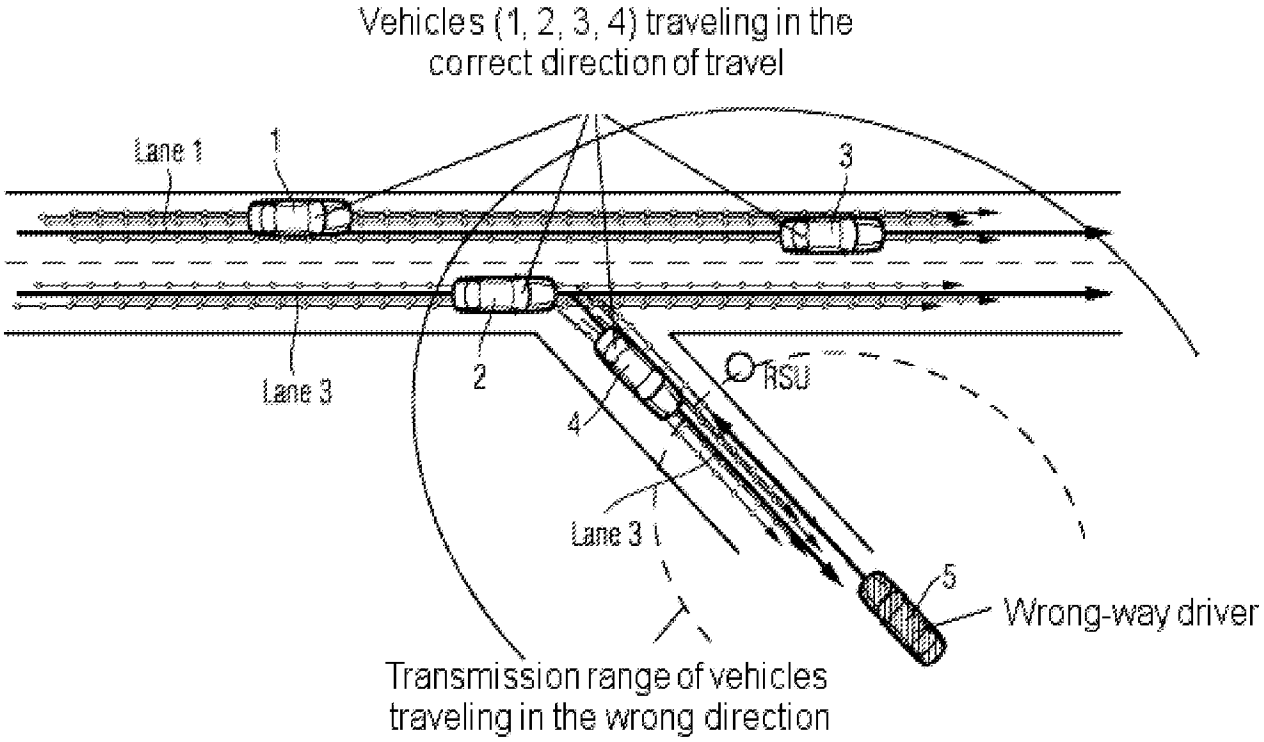

In the exemplary embodiment, radio transceiver devices for communicating within an ad hoc motor vehicle communication system, for example, a wireless motor vehicle communication system, are used for communication between transportation users. Ad hoc means so-called ad hoc networks, i.e., networks that are substantially self-organizing and are formed or operated spontaneously via direct communication between the network nodes involved. These networks are formed if, as illustrated in FIG. 1A, the radio supply areas (schematically depicted as ellipses) of the communication partners overlap in a suitable manner.

In road transportation, this communication involves motor vehicles and is therefore also called "car to car" (C2C) communication. However, this communication also includes communication with the transportation infrastructure formed, for example, by road side units (RSU), e.g., traffic lights, base stations formed for conveying the communication or disseminating information to information networks or controlling transport centers connected to the traffic lights. This communication is called "car to infrastructure" (C2I). Because motor vehicles are not the only transportation users, but rather bicycles and cyclists and pedestrians are likewise also involved, this communication also includes the interchange of data between radio transceiver devices operated by such users and the radio transceiver devices operated by motor vehicles. There is no term or acronym for this communication, but the communication falls under the term of "car to X" technology or communication (C2X).

In this case, this type of communication is distinguished from mobile radio communication because the former is implemented in an automated manner, i.e., predominantly without initiation or necessary actions by the user. The type of communication serves the purpose of collecting and interchanging transport-relevant data, such that all possible transportation situations may be reacted to appropriately, for example via warnings for the user or automated reactions of the motor vehicle.

In order to collect and interchange data, the exemplary embodiment provides for each motor vehicle to emit a cyclical message at an interval of 100 ms. The message may include details of speed, direction and position. The emission of cyclical standard messages (also called "beacons") may alternatively or additionally be used as the message from the receiver for determining a history.

In order to now avoid a hazardous situation, which is illustrated in FIG. 1A, and in which transportation users are traveling in the wrong direction, the individual trajectories (see arrows in FIG. 1B) recorded over time are used to gather the history. The history then ultimately represents the correct direction LANE1, LANE2 and LANE3 (thick arrows in FIGS. 1C and 1D) on the roads.

If, at a later time, a fifth transportation user 5 now travels in the opposite direction, i.e., the wrong direction, i.e., in the opposite direction to a first transportation user 1, a second transportation user 2, a third transportation user 3 and a fourth transportation user 4 (FIG. 1D), this wrong-way driving is detected based on the first messages that are periodically (cyclically) transmitted by the fifth transportation user to the road side unit RSU by virtue of the direction which results from the first messages. The first messages are investigated for correlation with the direction LANE3, which is determined as the likely correct direction by the history. The correlation value is substantially zero as a result of the completely opposite direction of the fifth transportation user 5.

The road side unit RSU then transmits a message to the fifth transportation user 5. The message triggers a procedure in the vehicle intended to resolve the hazardous situation. This may be an acoustic announcement, the content of which is a warning, or alternatively or additionally an overlay of a warning. Furthermore, the procedure may alternatively or additionally include an intervention in the control of the vehicle. The message may have the other transportation users 1 . . . 4 as a further destination, with the result that the drivers are also automatically warned of the ghost driver in a comparable manner to the fifth transportation user. An active intervention in vehicle control may additionally or alternatively occur in the case of these vehicles too.

A self-learning system may be provided that may dispense with a configuration with respect to the topology of the detected region. An effective system (e.g., a cost-effective system) is therefore also provided. All of the vehicles involved may therefore be forewarned in a short time and the procedures mentioned may be triggered in a short time. For this purpose, the road side units RSU may be configured with the self-learning procedure after installation.

Alternatively or additionally, transportation users may also assume the role of the road side unit RSU in order to achieve increased flexibility and coverage.

Figure 2:
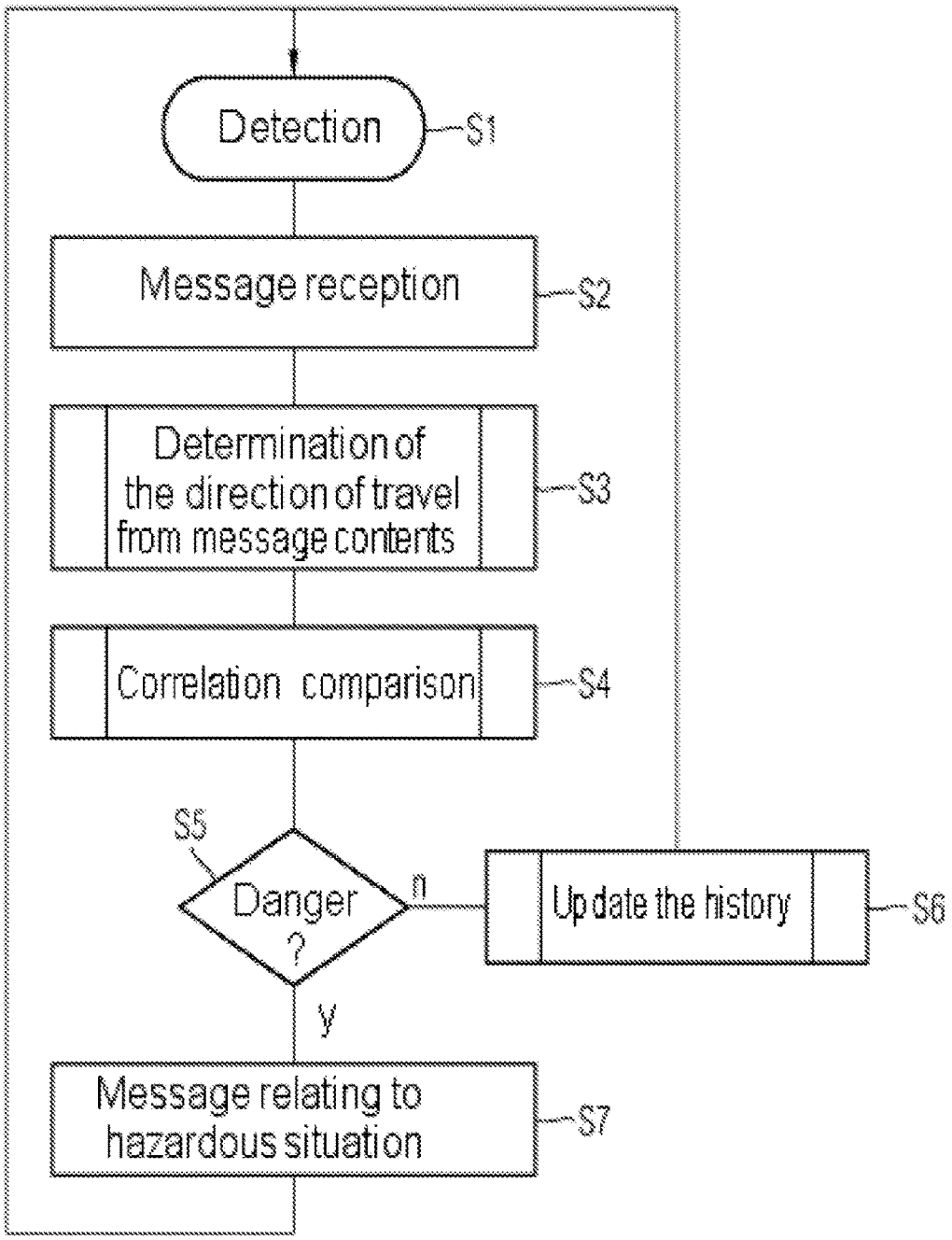
FIG. 2 shows a flowchart of an exemplary method implemented by a stationary transportation infrastructure device in accordance with one embodiment.

FIG. 2 illustrates the sequence of a method in accordance with an exemplary embodiment and from the point of view of a stationary transportation infrastructure device RSU.

In this case, the road side unit RSU changes from a first state in an act S1, in which the stationary transportation infrastructure device (road side unit) RSU is changed to a "detection" state, to the independent detection of the valid transport directions by evaluating the incoming first messages.

For this purpose, when a message arrives at the road side unit RSU in a second act S2, the first message is evaluated in a third act S3 with regard to an item of information from the direction of travel. The information may either be directly gathered or is determined in a procedure from the included data itself. For example, the current position of the vehicle emitting the message may be respectively determined as a result of the periodic transmission of the first message. The direction may be determined from the position change.

If the direction is then certain, the road side unit RSU may implement a comparison in a fourth act S4 with the history of the directions. The history is established by the directions determined in the past. The comparison may be implemented such that the extent to which there is a correlation between the two is determined.

In a fifth act S5, a check is then implemented in order to determine, from the comparison, whether or not there is danger. If there is no danger, the current direction may be used to update the history in a sixth act and the road side unit RSU may return to the starting state.

In contrast, if there is danger, a warning message is sent in a seventh act.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims can, alternatively, be made to depend in the alternative from any preceding or following claim, whether independent or dependent, and that such new combinations are to be understood as forming a part of the present specification.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. A method for communicating based on an ad hoc-type motor vehicle communication system, the method comprising:

receiving, by a radio transceiver device of a transportation infrastructure device, a first set of messages from a plurality of motor vehicles;

determining, by the transportation infrastructure device, a directional traffic flow history of a road based on the received first set of messages;

receiving, by the radio transceiver device, a second set of messages from a motor vehicle;

determining, by the transportation infrastructure device, a direction of a position change of the motor vehicle based on the received second set of messages;

determining, by the transportation infrastructure device, a correlation between the direction of the position change and the directional traffic flow history;

determining, by the transportation infrastructure device, a presence of a hazardous situation, wherein the presence of a hazardous situation occurs when there is a lack of correlation indicating travel in a wrong direction; and transmitting, by the radio transceiver device, a hazard message to the motor vehicle indicating the presence of the hazardous situation.

2. The method of claim 1, wherein the first and-second set of messages message are at least occasionally transmitted in a periodically repeated manner.

3. The method of claim 2, wherein a duration of the periodically repeated manner is set to 100 ms.

4. The method of claim 1, wherein determining the presence of the hazardous situation further comprises:

determining a value for time elapsed between a first message and a last transmitted message of the second set of messages;

determining whether the directional traffic history is formable, whether there is the correlation, or whether the directional traffic history is formable and whether there is the correlation; and determining the presence of the hazardous situation when the value exceeds a period of time and the directional traffic history is not formable or when there is no correlation.

5. The method of claim 1, wherein determining the presence of the hazardous situation further comprises:

determining whether the directional traffic history is formable, whether there is no correlation, or whether the directional traffic history is formable and whether there is no correlation.

6. The method of claim 1, wherein the first set of messages include a first item of information representing a direction of travel, position, speed, or any combination thereof, of each motor vehicle of the plurality of motor vehicles.

7. The method of claim 1, wherein the hazard message comprises an item of information that triggers a warning.

8. The method of claim 1, wherein message transmission is implemented according to a dedicated short-range radio communication standard.

9. The method of claim 1, wherein message transmission is implemented according to a wireless access in vehicular environments (WAVE) standard or derivatives thereof.

10. The method of claim 1, wherein message transmission is at least partially implemented according to IEEE 1609.4, intelligent transportation systems (ITS) standards or derivatives of the ITS standards, or any combination thereof.

11. The method of claim 1, wherein message transmission is at least partially implemented according to IEEE 802.11 standards or derivatives thereof.

12. The method of claim 1, wherein higher-priority first message transmission comprising safety-relevant data transmission is formed according to IEEE 802.11e or IEEE 802.11p.

13. The method of claim 1, wherein lower-priority second message transmission comprising user-specific data transmission is formed according to IEEE 802.11a/b/g.

14. The method of claim 1, wherein communication with the motor vehicle is at least partially implemented according to a mobile radio standard.

15. The method of claim 1, wherein communication with the motor vehicle is at least partially implemented according to an intelligent transportation systems (ITS) standard, a vehicle safety communications program (VSC) or an advanced vehicle safety program (AVS).

16. The method of claim 1, wherein communication with the motor vehicle is at least partially implemented according to a continuous-air long and medium range (CALM) standard.

17. A transportation infrastructure device for communicating based on an ad hoc-type motor vehicle communication system, the transportation infrastructure device comprising:

a radio transceiver device configured to:

receive a first set of messages from a plurality of motor vehicles;

receive a second set of messages from a motor vehicle; and transmit a hazard message to the motor vehicle based on a presence of a hazardous situation on a road, wherein the transportation infrastructure device is configured to:

determine a directional traffic flow history of the road based on the first set of messages received from the plurality of motor vehicles;

determine a direction of a position change of the motor vehicle based on the received second set of messages;

determine a correlation between the direction of the position change of the motor vehicle and the directional traffic flow history; and determine the presence of the hazardous situation indicating travel on the road in a wrong direction when there is a lack of correlation.

18. A transportation user device of a transportation user for communicating based on ad hoc-type motor vehicle communication system, via which transportation users communicate with one another, the transportation users communicate with a transportation infrastructure, or the transportation users communicate with one another and the transportation infrastructure, the transportation user device comprising:

a first radio transceiver device associated with the transportation user device configured to transmit a plurality of messages to a transportation infrastructure device or another transportation user in a radio supply area of the radio transceiver device and receive a hazard message when a direction of a position change of the transportation user is not correlated with a traffic flow direction of a location of the transportation user, wherein each message of the plurality of messages includes a position the transportation user on at least one road;

wherein the transportation user device implements an automated procedure based on the receipt of the hazardous situation when a degree of correlation value of the direction of the position change and the traffic flow direction is substantially zero, revealing a hazardous situation.

* * * * *